United States Patent [19]

Collet

[11] Patent Number: 4,523,599

[45] Date of Patent: Jun. 18, 1985

[54] ATTACHABLE TOOTHBRUSH

[76] Inventor: Georges Collet, P.O. Box 19.000, Caracas, Venezuela

[21] Appl. No.: 462,619

[22] Filed: Jan. 31, 1983

[51] Int. Cl.[3] ..... A45D 44/18

[52] U.S. Cl. ..... 132/84 D

[58] Field of Search ..... 132/84 D, 84, 85; 401/131; 429/100; 248/108, 466; 128/291; 40/152.1; 427/208, 40

[56] References Cited

U.S. PATENT DOCUMENTS

| | | | |
|---|---|---|---|
| 2,599,359 | 6/1952 | Banks et al. | 427/208 |
| 3,387,341 | 6/1968 | Mates et al. | 401/131 |
| 4,161,050 | 7/1979 | Sasaki | 132/85 |

FOREIGN PATENT DOCUMENTS

| | | | |
|---|---|---|---|
| 2646265 | 4/1978 | Fed. Rep. of Germany | 401/131 |

*Primary Examiner*—Gregory E. McNeill
*Attorney, Agent, or Firm*—John Cyril Malloy

[57] ABSTRACT

A toothbrush and holder comprising a rigid elongate member and an attachment member for releasable attachment together. The elongate member has a brush portion and a handle portion, said brush portion having bristles which extend perpendicularly from the brush portion, said bristles having rounded ends for confronting brushing against the teeth of a user, and said handle portion having an insert for cooperative attachment to a corresponding first portion on the attachment member. The attachment member has a second portion which is parallel to said first attachment portion and which is separated a distance from said attachment portion which is greater than the length of the bristles such that when the elongate member is attached to the attachment member the bristles confront but do not touch the plane of the second portion of the attachment member.

6 Claims, 6 Drawing Figures

ATTACHABLE TOOTHBRUSH

FIELD OF THE INVENTION

This invention relates to dental hygiene, and more specifically to attachable and releasable toothbrush apparatus.

BACKGROUND OF THE INVENTION

In the past there have been numerous types of toothbrushes and accessories designed to hold the toothbrush when not in use. This invention generally is of such a toothbrush and accessory which is improved as is set forth more fully hereinafter and which is composed of a toothbrush with an insert in the handle portion which corresponds to an accessory which is attachable to a fixed surface. The attachment accessory has two confronting surfaces, one which is for fixed confrontation to a fixed surface and a second surface which is designed for confrontment with the handle portion of the toothbrush such that the toothbrush may be releasably attached to said surface of the attachment accessory.

In the preferred embodiment, the device is designed to hang on a vertical wall such that the brush portion confronts the wall without touching said wall when it is attached to the attachment accessory. The center of gravity is designed in the toothbrush to be between the insert in the handle portion and the brush portion such that when the toothbrush is attached to the attachment accessory, the natural proclivity of the device will be for the brush portion to face downward beneath the insert. In this manner, the toothbrush is allowed to dry when not in use and to be kept from touching external surfaces which might cause bacteria to develop on the brush portion.

A further development in the applicant's device has been the rounding of the tips of the bristles in order to reduce damage to the gums and to prevent scratching of the enamel of the teeth when in use. This contrasts to the tips of the bristles in the prior art which were not specially designed an resulted in some damage in the mouth.

OBJECTS OF THE INVENTION

An object of this invention is to provide a simple attachment means for holding a toothbrush when not in use without allowing the brush area to come into contact with any external surfaces.

A further object of this invention is to provide a quick releasable mechanism for retaining the toothbrush in an easily accessible location.

Another object of this invention is to provide a holding means such that the bristles are allowed to face downward to dry quickly and easily when not in use.

A fourth object of this invention is to provide a toothbrush with bristles having rounded ends for protecting the gums and enamel of a user from being scratched or otherwise damaged.

DESCRIPTION OF THE PREFERRED EMBODIMENT

Figure 1:
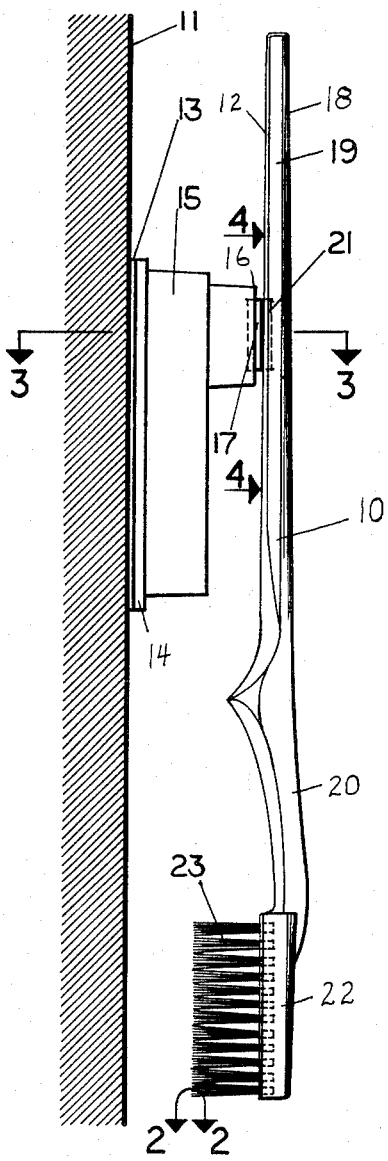
FIG. 1 is a side profile of the toothbrush and attachment accessory attached to a fixed surface.
Figure 6:
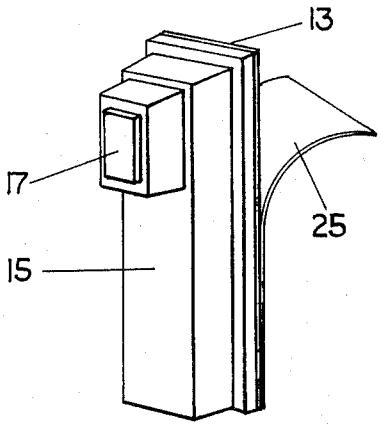
FIG. 6 is a front angular view of the attachment accessory including a removable back strip covering the tacky surface designed to be fixed to the wall.

Referring to the drawings wherein like reference characters designate like or corresponding parts throughout the several views, FIG. 1 generally designates a toothbrush 10 having an insert 21 on the front surface 12 of the handle 19. The insert 21 is designed to cooperatively engage with a plate 17 which is fixed to the surface 16 of the attachment member 15. The attachment member 15 has a surface 14 which is fixed to a strip of two-way tape 13. The tape 13 is designed with a cover strip 25 as seen in FIG. 6 which is to be removed in order to allow fixation of the attachment member 15 to a fixed surface 11.

Figure 2:
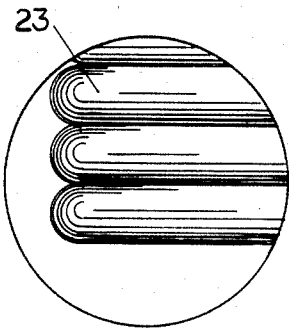
FIG. 2 is a blown-up view of the tips of the bristles.

The toothbrush is composed of a handle 19, a neck 20, and a brush 22 which are generally linearly disposed from the handle 19 to the brush 22. The brush 22 has bristles 23 which extend perpendicularly from the front surface 12 and are arranged in columns and rows, and are sized for the mouth. The bristles 23 have ends which are rounded, as is shown in the blow-up view in FIG. 2. The rounded ends of the bristles 23 are designed to reduce the risk of damage to the mouth of a user such as may be caused by sharp, pointed bristles or objects. The bristles 23 are disposed a given distance from the front surface 12 which is less than the distance separating the surface 16 from the surface 14 of the attachment member 15, such that when the toothbrush 10 is attached to the attachment member 15, the bristles 23 confront the fixed surface 11 but do not touch it. This arrangement allows the bristles to dry, when not in use, without being contaminated by contact with external surfaces. Furthermore, the inward disposition of the bristles 23 towards the wall 22 reduces the risk of accidental contact with the bristles 23 when the toothbrush 10 is not in use.

Figure 3:
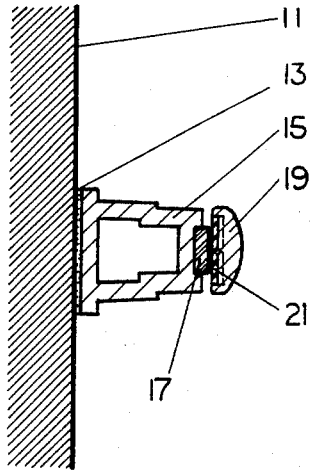
FIG. 3 is a cross-sectional view of the toothbrush and accessory as seen from line 3—3 in FIG. 1.
Figure 4:
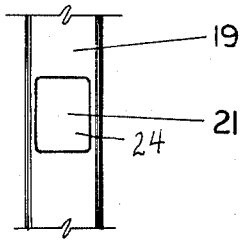
FIG. 4 is a cutaway view of the insert in the handle portion as seen in the plane 4—4 of FIG. 1.
Figure 5:
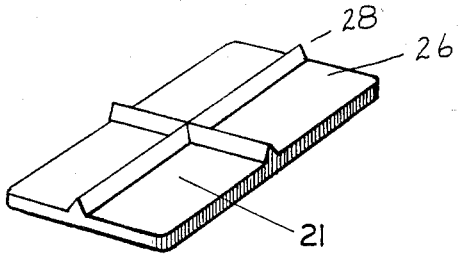
FIG. 5 is a view of the back of the insert which is confrontingly attached to the handle.

The handle 19 of the toothbrush is designed to be compatably held by the fingers of a user. The front surface 12 is flat-like and the back surface 18 has an arcuate cross-section as seen in FIG. 3. The handle portion joins the tapered neck at an interface area which juts outward from the front surface 12 to provide a ridge to prevent hand slippage. The flat front surface 12 of the handle 19, also, is designed to flushly mate with the attachment means at the insert 21. The insert 21 has an outer surface 24 and an inner surface 26 such that the outer surface 24 is flat and designed to maximize surface contact with the corresponding plate 17. The inner surface 26 of the insert has a ridge network 28 which is designed to increase bondability of the insert to the handle 19 by creating more surfaces and angles with which to mesh.

In the preferred embodiment, the insert 21 is made of magnetically attractive metal and the plate 17 is a magnet. The plate 17 is flat and designed to extend above the surface 16 of the attachment member 15 to which the plate 17 is fixed in order to facilitate contact between the plate 17 and the insert 21. Preferably, the surfaces 16 and 14 are coplanar such that when the nearly linear toothbrush 10 attaches to the attachment member 15, the toothbrush is held in a plane which is nearly coplanar with the surfaces 14 and 16 of the attachment member and the fixed surface 11. This particular arrangement allows for a reduced magnet size and still provides for maintenance of the bristles away from contaminating surfaces.

In the preferred embodiment, the center of gravity of the toothbrush 10 will lie between the insert 21 of the handle 19 and the brush 22 which will cause the brush 22 to naturally hang below the insert 21 when attached to the attachment member 15 which is fixed to a vertical wall 11.

In an alternative embodiment, the center of gravity of the toothbrush 10 could be placed at or near the insert 21 to provide for attachment of the attachment member 15 to a horizontal surface such that the bristles would be held apart from contaminating surfaces and facing downward to provide for quick drying.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatuses and articles.

What is claimed is:

1. A toothbrush and holder comprising:

(a) said toothbrush including a rigid elongate member and said holder including an attachment member, both said elongate member and said attachment member cooperatively structured for releasable attachment to one another, (b) said elongate member including a handle portion and a brush portion interconnected to one another and a first and a second side substantially extending along the length of both said handle and brush portions, (c) a metallic insert mounted within said handle portion and including a front surface disposed in exposed, accessible relation to said first side of said handle portion, (d) said brush portion comprising bristle means extending outwardly from said first side of said brush portion a first distance and being sized for the mouth, (e) said attachment member having a first and a second attachment surface being spaced apart a second distance, said first attachment surface including mounting means thereon disposed for engagement with a fixed surface, (f) said second attachment surface disposed substantially parallel to said first attachment surface and including a plate affixed thereto, said plate structured and disposed to magnetically attract and mate with said front surface of said insert, (g) said plate and said insert being cooperatively disposed, when mated, to support said elongate member in a plane substantially parallel to said second attachment surface, (h) said attachment member being structured cooperatively with said elongate member such that said second distance of said attachment member is greater than said first distance of said brush portion and said bristle means is confrontingly disposed and spaced from the plane of said first attachment surface.

2. A device as in claim 1 wherein said insert is mounted about the center of gravity of said elongate member, said brush portion naturally disposed below said insert when said elongate member is mounted on a vertical wall by said attachment member.

3. A device as in claim 1 wherein said insert further comprises a back surface embedded within said handle portion and including ridge means extending outwardly from said back surface, whereby said back surface has an increased surface area to facilitate bonding within said handle portion.

4. A device as in claim 3 wherein said mounting means comprises tape means including a first and a second adhesive surface, said first adhesive surface being sized to cover said first attachment surface and being fixed thereto and said second adhesive surface being outwardly disposed for engagement with a flat fixed surface.

5. A device as in claim 4 wherein said bristle means comprises a plurality of bristles arranged in a series of columns and rows which extend substantially perpendicularly outwardly from said first side of said brush portion said first distance, said bristles having ends which are rounded.

6. A device as n claim 1 wherein said insert is fixed at a point substantially adjacent the center of gravity of said elongate member and said attachment member is secured to a horizontal surface, said bristle means being disposed to hang downwardly in confronting relation to the plane of said first surface of said attachment member and in spaced relation thereto.

* * * * *